US006247595B1

(12) United States Patent
Omata et al.

(10) Patent No.: US 6,247,595 B1
(45) **Date of Patent: *Jun. 19, 2001**

(54) FLAT TABLET CASE WITH A HINGED CAP

(75) Inventors: Katsuhiko Omata; Yuji Sugiyama; Mikiko Suzuki; Hisashi Aizawa, all of Shinjuku-ku (JP)

(73) Assignee: Dai Nippon Printing Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/289,622

(22) Filed: Apr. 12, 1999

Related U.S. Application Data

(63) Continuation of application No. 09/000,338, filed on Jan. 20, 1998, now Pat. No. 5,947,294.

(30) Foreign Application Priority Data

May 27, 1996 (JP) ..... 8-131507

(51) Int. Cl.[7] ..... B65D 83/04

(52) U.S. Cl. ..... 206/534.2; 206/538; 206/540; 221/303; 220/326; 220/837

(58) Field of Search ..... 206/534.1, 534.2, 206/540, 1.5, 828, 387.1; 221/303, 312 R, 312 C; 220/326, 4.21, 524, 525, 835, 837

(56) References Cited

U.S. PATENT DOCUMENTS

| | | | | |
|---|---|---|---|---|
| 3,127,225 | * | 3/1964 | Oehrlein | 220/837 |
| 3,190,437 | * | 6/1965 | Tamarin . | |
| 5,004,106 | * | 4/1991 | Blumstock et al. . | |
| 5,405,007 | | 4/1995 | Iwahashi . | |
| 5,482,172 | * | 1/1996 | Braddock | 220/837 |
| 5,630,508 | | 5/1997 | Petit . | |

FOREIGN PATENT DOCUMENTS

| | | | |
|---|---|---|---|
| 425086 | | 5/1967 | (CH) . |
| 2850958 | | 5/1979 | (DE) . |
| 92 13 012 U | * | 1/1993 | (DE) . |
| 0 628 496 A1 | * | 12/1994 | (EP) . |
| 3-111987 | | 11/1991 | (JP) . |

* cited by examiner

*Primary Examiner*—Shian Luong

(57) ABSTRACT

A flat tablet case (A) is assembled by joining together a bottom half case (30) having the shape of a rectangular tray and a top half case (10) having the shape of a rectangular tray. A plurality of studs (21 to 25) are formed on the inner surface of the top half case (10), and a plurality of sockets (41 to 45) are formed on the inner surface the bottom half case (30). A hinged cap (50) is formed integrally with the bottom half case (30) in a section of the side wall (31) excluding corners. The hinged cap (50) is provided on its opposite side surfaces with projections (53, 54) which are engaged with and disengaged from cap holding structures (35, 36) formed on the bottom half case (30).

5 Claims, 9 Drawing Sheets

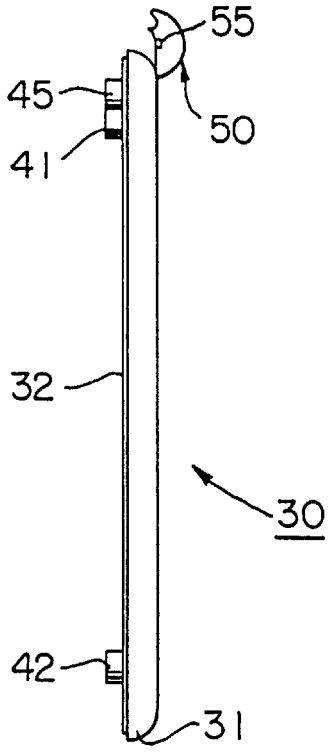
FIG. 7
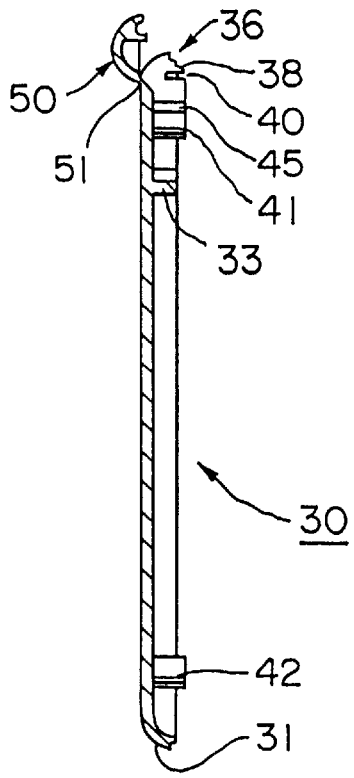
FIG. 8
FIG. 9A
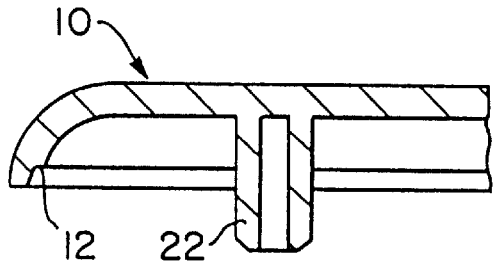
FIG. 9B
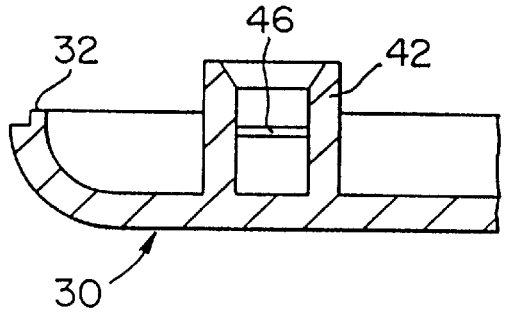

FLAT TABLET CASE WITH A HINGED CAP

This is a Continuation of application Ser. No. 09/000,338 filed Jan. 20, 1998, now U.S. Pat. No. 5,947,294.

TECHNICAL FIELD

The present invention relates to a flat tablet case for carrying and dispensing refreshing tablets or the like.

BACKGROUND ART

A conventional case for carrying and dispensing refreshing tablets or the like has a dispensing opening and is provided a sliding cap for opening and closing the dispensing opening.

Such a conventional case having a delivery opening and provided with a sliding cap for opening and closing the dispensing opening, comprises a relatively large number of parts, is expensive, cannot be provided with the dispensing opening in its side wall due to structural restrictions and is not satisfactory in usability.

The present invention has been made in view of the foregoing problems and it is therefore an object of the present invention to provide an inexpensive, flat tablet case comprising a relatively small number of parts and satisfactory in usability.

DISCLOSURE OF THE INVENTION

The present invention provides the following flat tablet case with a hinged cap.

A flat tablet case comprises a bottom half case, a top half case combined with the bottom half case, and a hinged cap having a hinge portion and formed integrally with one of the bottom half case and the top half case so as to swing on the hinge portion. In this flat tablet case, a recess is formed in the other of the top half case and the bottom half case to receive the hinged cap therein. The hinged cap is provided with projections on its opposite side surfaces, and the one half case integrally provided with the hinged cap has cap holding structures with which the projections of the hinged cap engage. Each of the cap holding structures has a rib and a groove formed on a turning path of the corresponding projection of the hinged cap.

BRIEF DESCRIPTION OF THE DRAWINGS

FIG. 7 is a side view of the bottom half case shown in FIG. 6;

FIG. 8 is a sectional view taken on line Y—Y in FIG. 6;

FIG. 9A is an enlarged sectional view of a portion of a top half case provided with a stud;

FIG. 9B is an enlarged sectional view of a portion of a bottom half case provided with a socket;

BEST MODE FOR CARRYING OUT THE INVENTION

Preferred embodiments of the present invention will be described hereinafter with reference to the accompanying drawings.

Figure 1:
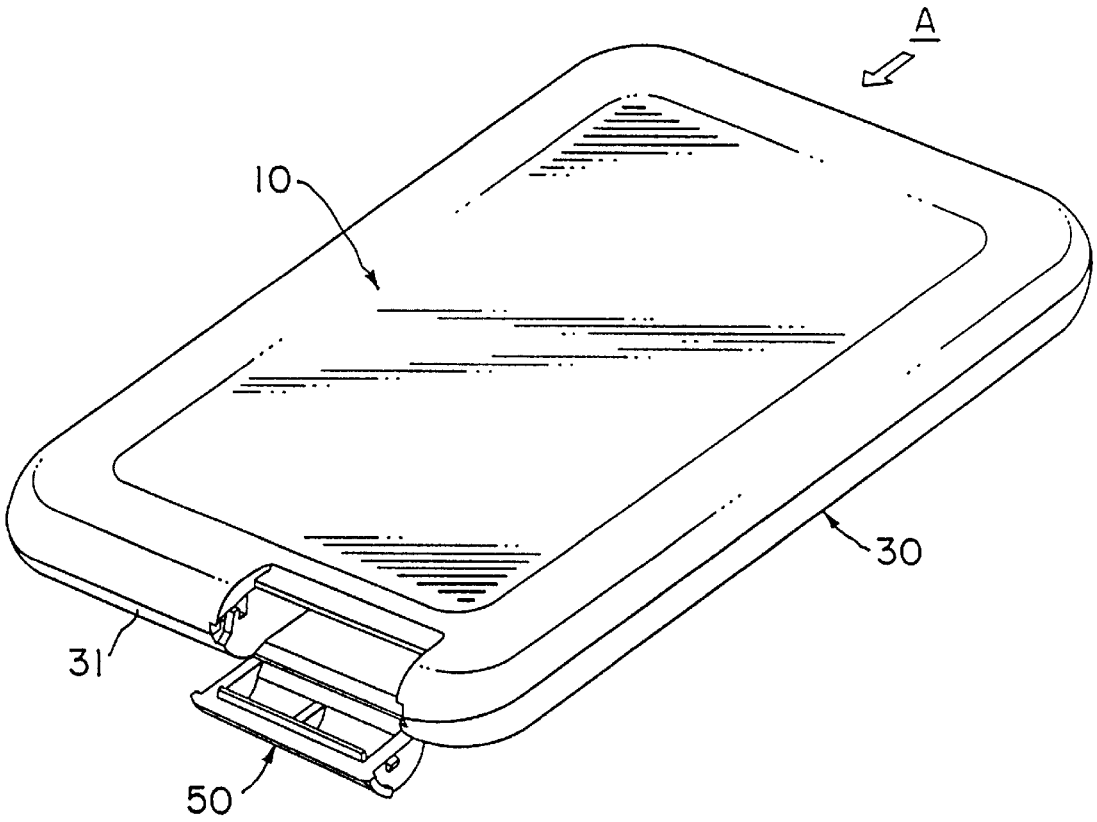
FIG. 1 is a perspective view of a flat tablet case with a hinged cap in a first embodiment according to the present invention.
Figure 2:
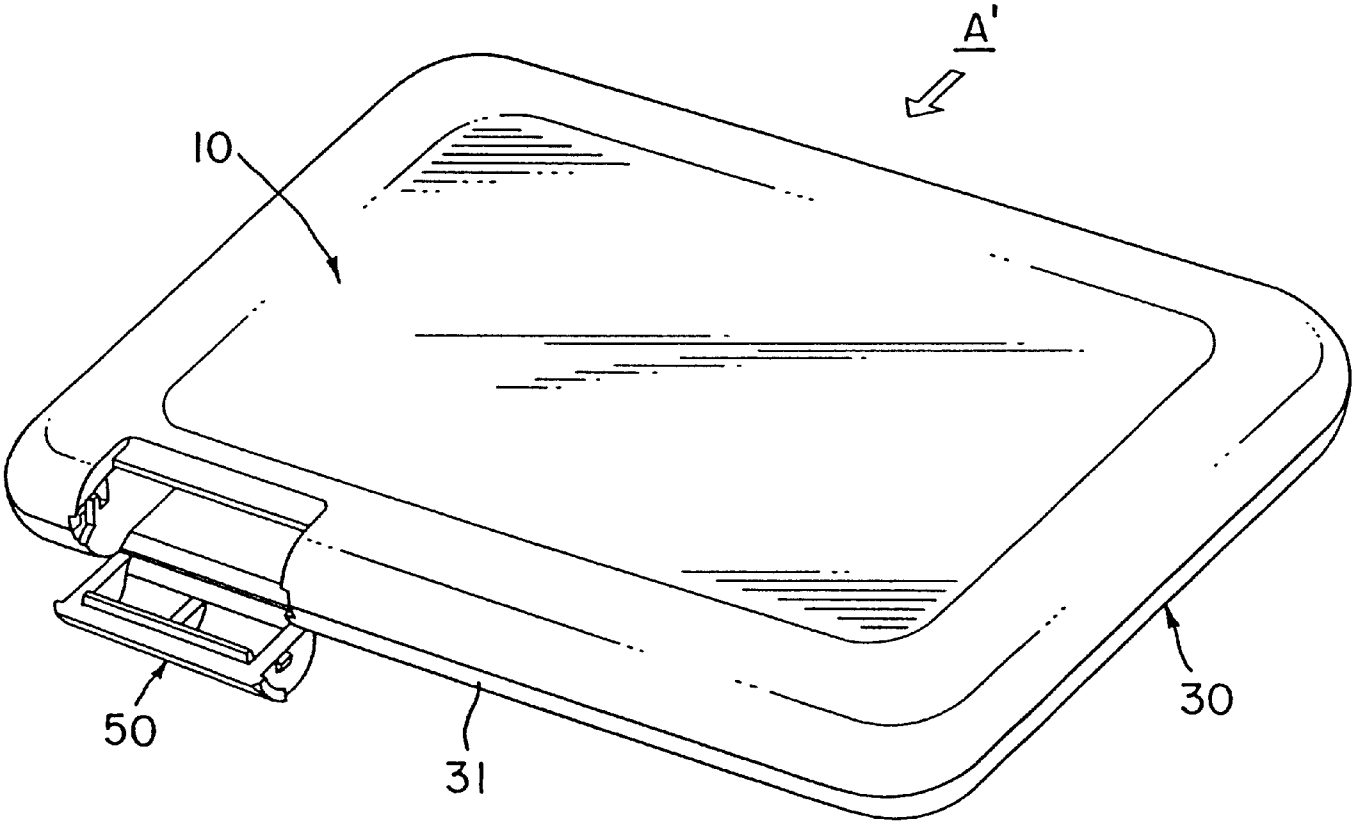
FIG. 2 is a perspective view of a flat tablet case with a hinged cap in a second embodiment according to the present invention.
Figure 3:
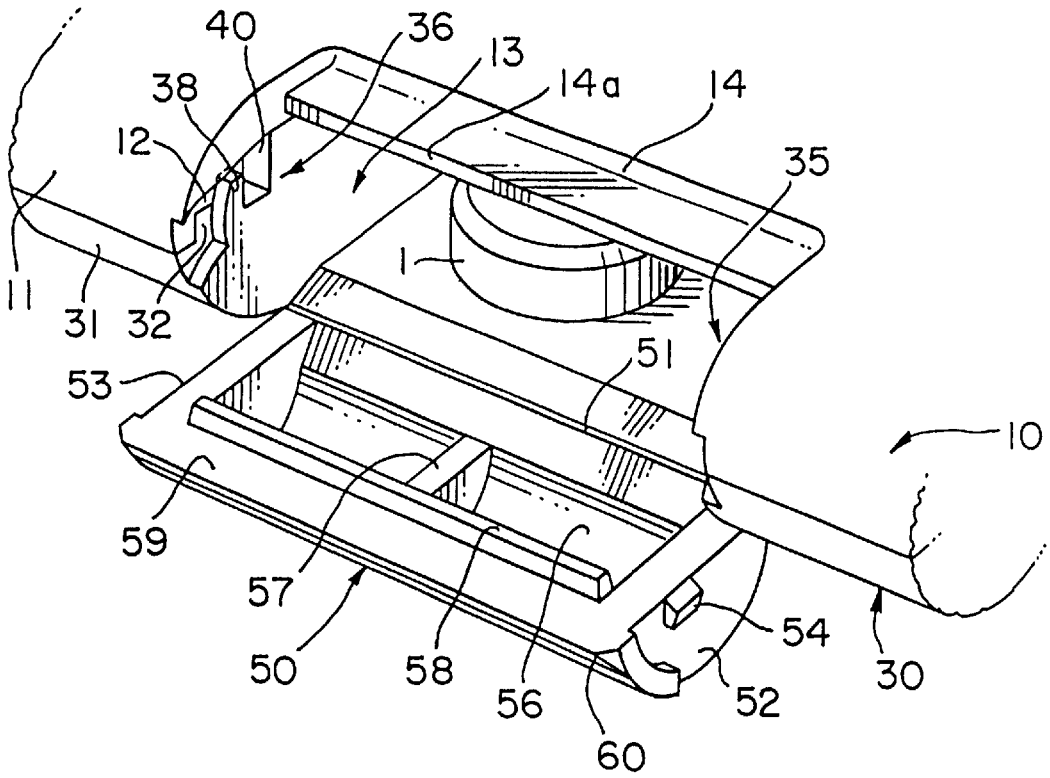
FIG. 3 is an enlarged perspective view of a hinged cap and a portion associated with the hinged cap.
Figure 4:
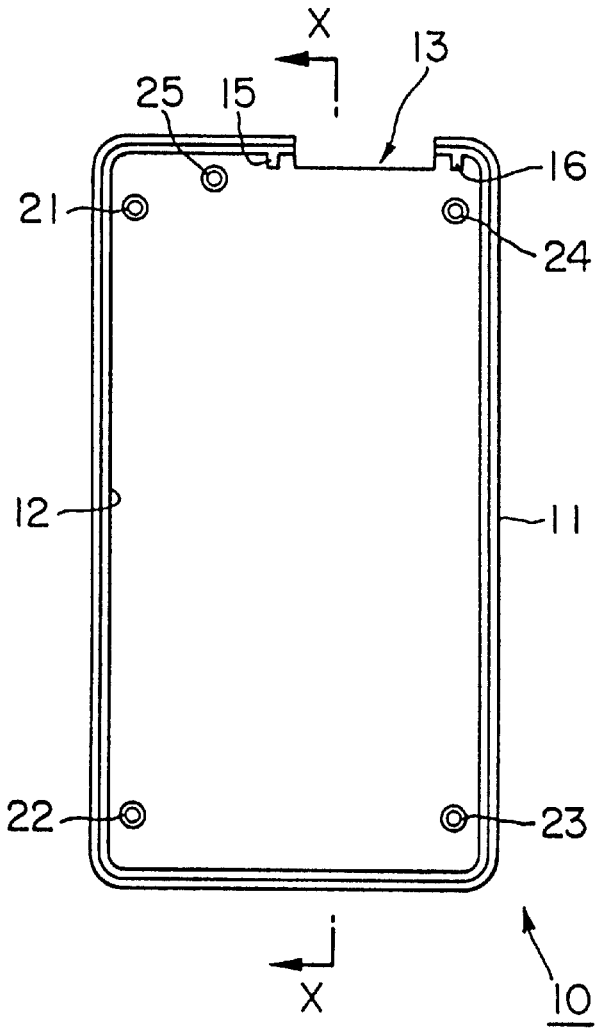
FIG. 4 is a plan view of a top half case shown in FIG. 1.
Figure 5:
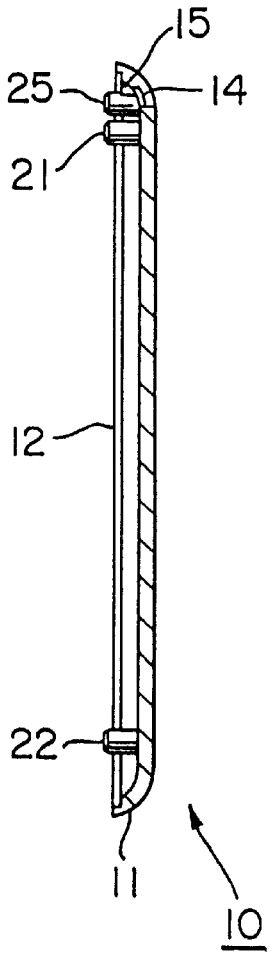
FIG. 5 is a sectional view taken on line X—X in FIG. 4.
Figure 6:
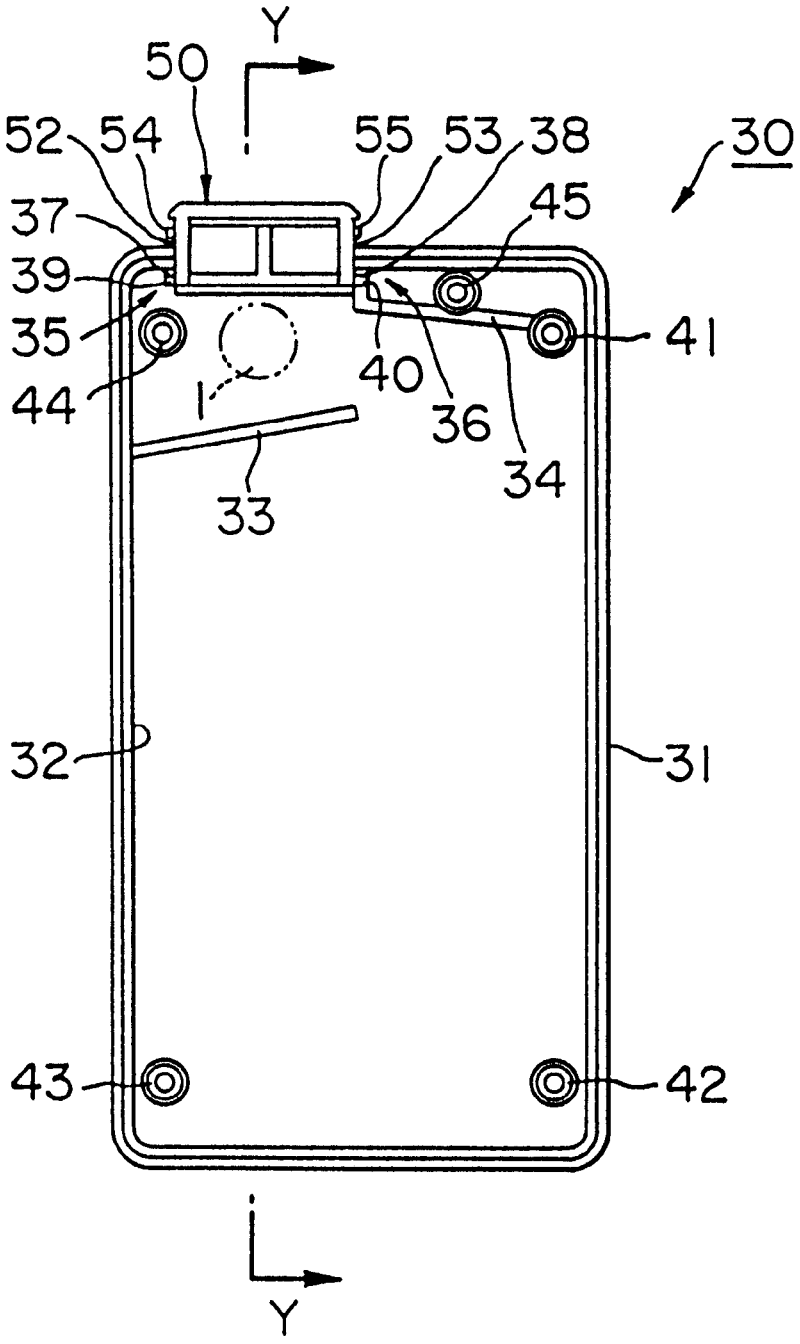
FIG. 6 is a plan view of a bottom half case shown in FIG. 1.
Figure 10:
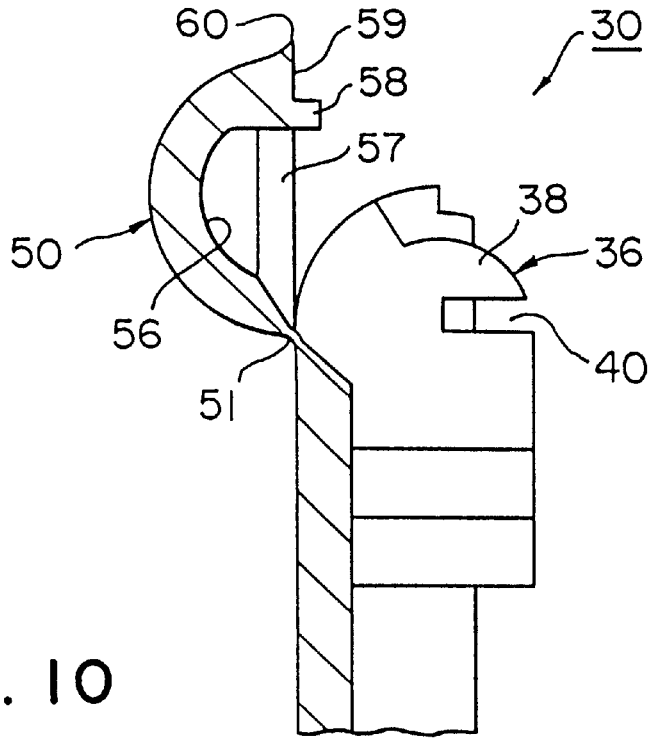
FIG. 10 is an enlarged sectional side view of a hinged cap.
Figure 11:
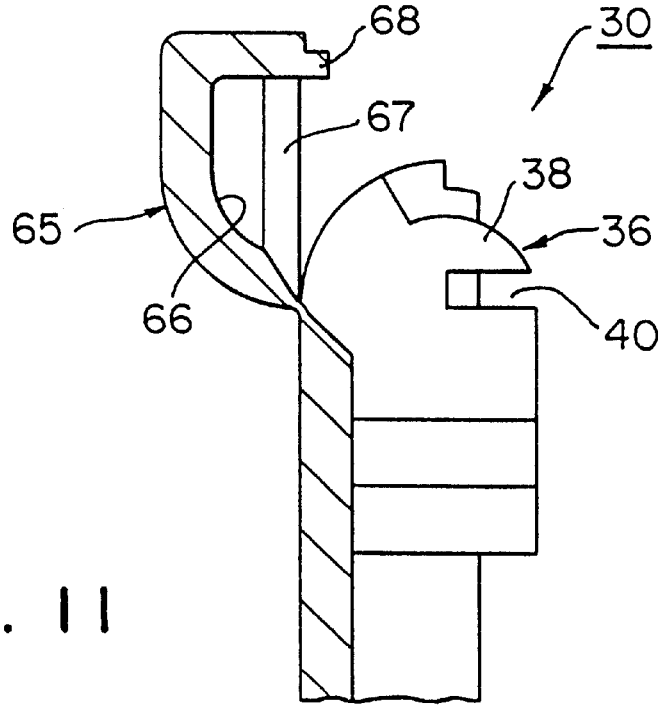
FIG. 11 is an enlarged sectional side view of another hinged cap.
Figure 12:
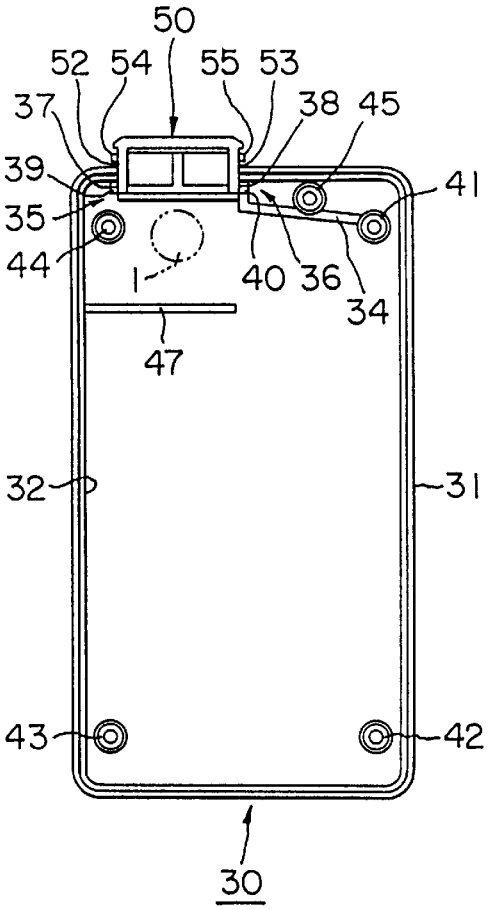
FIG. 12 is a plan view of a bottom half case shown in FIG. 1 and provided with a rib at a different position.
Figure 13:
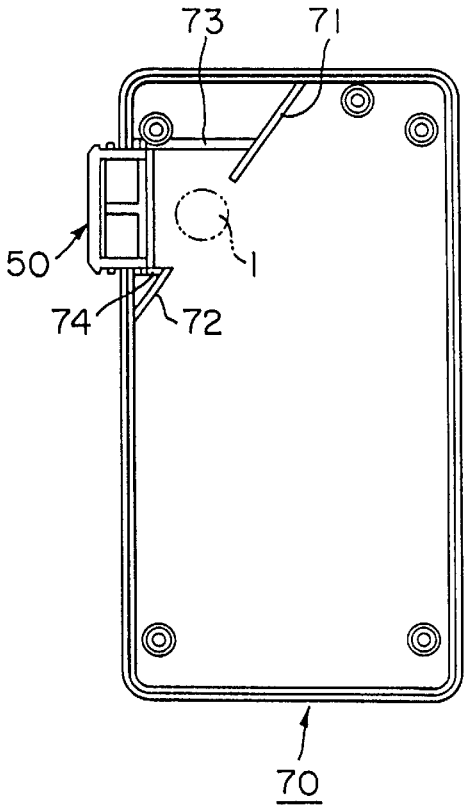
FIG. 13 is a plan view of a bottom half case shown in FIG. 2.

FIG. 1 is a perspective view of a flat tablet case with a hinged cap in a first embodiment according to the present invention, FIG. 2 is a perspective view of a flat tablet case with a hinged cap in a second embodiment according to the present invention, FIG. 3 is an enlarged perspective view of a hinged cap and a portion associated with the hinged cap, FIG. 4 is a plan view of a top half case included in the first embodiment, FIG. 5 is a sectional view taken on line X—X in FIG. 4, FIG. 6 is a plan view of a bottom half case included in the first embodiment, FIG. 7 is a side view of the bottom half case shown in FIG. 6, FIG. 8 is a sectional view taken on line Y—Y in FIG. 6, FIGS. 9A and 9B are enlarged sectional views of a portion of a top half case provided with a stud and a portion of a bottom half case provided with a socket, respectively, FIG. 10 is an enlarged sectional side view of a hinged cap, FIG. 11 is an enlarged sectional side view of a hinged cap included in a further embodiment, FIG. 12 is a plan view of a bottom half case shown in FIG. 1 and provided with a rib at a different position, and FIG. 13 is a plan view of a bottom half case included in the second embodiment.

The present invention is not limited in its practical application to the first and the second embodiment illustrated in the drawings and suitable changes in design may be made therein without departing from the scope and spirit of the present invention.

The present invention will be briefly described with reference to perspective views shown in FIGS. 1 to 3. As shown in FIGS. 1 and 2, a flat tablet case A with a hinged cap 50 is formed by assembling a flat top half case 10 having the shape of a tray, and a bottom half case 30 substantially the same in shape as the top half case 10. The hinged cap 50 having a flexible, thin hinge portion 51 is formed integrally with the bottom half case 30 in a section of a side wall 31 of the bottom half case 30 excluding corners. The top half case 10, the bottom half case 30 and the hinged cap 50 can be formed in desired shapes, respectively, by molding a thermoplastic resin, such as a polypropylene resin, a polyethylene resin or a polystyrene resin. The hinged cap 50 is formed integrally with a shorter side wall in the flat tablet case shown in FIG. 1, and the same is formed integrally with a longer side wall in the flat tablet case shown in FIG. 2. The top half case 10 and the bottom half case 30 are provided on their inner surfaces with a plurality of studs and sockets, respectively, which will be described later. The studs are forced into the corresponding sockets to assemble the flat tablet case A. A ridge 32 continuously extending on a joining surface of the side wall 31 of the bottom half case 30 excluding a portion corresponding to the hinged cap 50 is fitted in a recessed edge portion 12 continuously extending on a joining surface of the side wall of the top half case 10. Therefore, the interior of the flat tablet case A is not exposed even if a gap is formed between the joining surfaces of the top half case 10 and the bottom half case 30 when the top half case 10 and the bottom half case 30 are joined together, and the top half case 10 and the bottom half case 30 cannot be easily dislocated laterally relative to each other and cannot be easily separated from each other.

The hinged cap 50 is formed integrally with the bottom half case 30 and is provided on its opposite side surfaces 52 and 53 with projections 54 and 55, which engage with cap holding structures 35 and 36 formed on the bottom half case 30 to hold the hinge cap 50 in a closed position. In FIGS. 1 to 3, the hinged cap 50 is in an open position. Indicated at 1 in FIG. 3 is a tablet contained in the flat tablet case A.

The top half case 10 and the bottom half case 30 of the flat tablet case A will be described in detail. As shown in FIGS. 4 and 5, each of the inner and the outer surface of the side wall 11 of the top half case 10 excluding a portion thereof corresponding to the hinged cap 50 has a substantially quadrantal cross section. As shown in FIG. 4, a rectangular recess 13 for receiving the hinged cap 50 therein is formed in the top half case 10. As shown in FIGS. 1 to 3 and 5, a flange 14 is formed so as to project from the bottom surface of the rectangular recess 13 parallel to the shorter side of the flat tablet case and to extend in parallel to the hinge portion 51 and continuously with the upper surface of the top half case 10. The upper surface of the flange 14 is on a level lower than that of the upper surface of the top half case 10. The recessed edge portion 12 of a depth slightly greater than the height of the ridge 32 formed on the joining surface of the side wall 31 of the bottom half case 30 is formed continuously on the joining surface of the side wall 11 of the top half case 10 excluding the portion of the side wall in which the rectangular recess 13 is formed. Partition walls 15 and 16 having end surfaces recessed from the joining surface of the side wall 11 and extending on substantially the same level as the recessed edge portion 12 are formed at positions on the opposite sides of the rectangular recess 13 on the inner surface in parallel to the longer sides of the flat tablet case so that their inner ends correspond substantially to the bottom surface of the rectangular recess 13.

A plurality of studs (five studs in FIG. 4) to be fitted in sockets of the bottom half case 30 are formed in the peripheral region of the inner surface of the top half case 10. The first stud 21, the second stud 22, the third stud 23 and the fourth stud 24 are formed in longer sections of the side wall of the top half case 10 near the corners of the case, and the fifth stud 25 is formed at the middle between the partition wall 15 and the first stud 21. As shown in FIG. 9A, the studs 21, 22, 23, 24 and 25 are hollow, round projections and have end portions having the shape of a frustum. (All the studs are the same as the stud 22 shown in FIG. 9A.)

As shown in FIGS. 6 to 8, the inner and the outer surface of the side wall 31 of the bottom half case 30 excluding a portion thereof corresponding to the hinged cap have substantially quadrantal shapes in section, respectively. The thin, flexible hinge portion 51 of the hinged cap 50 is formed integrally with a portion of the bottom half case 30 which corresponds to the rectangular recess 13 of the top half case 10 when the top half case 10 and the bottom half case 30 are assembled. The hinged cap 50 is able to swing on the hinge portion 51. The ridge 32 is formed on the joining surface of the side wall 31 of the bottom half case 30 excluding a portion in which the hinged cap 50 is formed. An exit partition wall 33 of substantially the same height from the inner surface of the bottom half case 30 as the ridge 32 is extended on the inner surface of the bottom half case 30 from a portion of a longer section of the side wall near the hinged cap 50. The exit partition wall 33 enables only a small number of tablets 1 to be discharged at a time, prevents the discharge of excessively many tablets 1 at a time and enables the tablets to be shook out of the flat tablet case without blocking. The exit partition wall 33 is inclined slightly toward the side of the hinged cap 50 and extends from one longer side toward the other longer side to a position near the longitudinal center axis of the bottom half case 30 perpendicular to the shorter sides.

A first socket 41, a second socket 42, a third socket 43, a fourth socket 44 and a fifth socket 45 are formed in the peripheral region of the inner surface of the bottom half case 30 so as to be mated with the studs 21, 22, 23, 24 and 25 of the top half case 10, respectively. As shown in FIG. 9B, the sockets 41 to 45 are hollow, round projections provided with a round bore having a tapered end portion and a neck 46. (All the sockets are the same as the socket 42 shown in FIG. 9B.) Thus, the studs 21, 22, 23, 24 and 25 can be easily fitted in and can be firmly held in the sockets 41, 42, 43, 44 and 45, respectively.

A partition wall 34 is extended from the first socket 41 to the cap holding structure 36 for holding the hinged cap 50 so as to be tangent to the fifth socket 45. The partition wall 34 has substantially the same height from the inner surface of the bottom half case 30 as the ridge 32 on the side wall 31. The partition wall 34 prevents the entrance of the tablets into a space between the first and the fifth socket, and the side wall.

The hinged cap 50 and the cap holding structures 35 and 36 will be described hereinafter. The inner and the outer surface of the hinged cap 50 have substantially semicircular shapes in section, respectively. The external appearance of the hinged cap 50 is substantially the same as the side wall of the flat tablet case A formed by assembling the top half case 10 and the bottom half case 30. The hinged cap 50 is provided on its opposite side surfaces 52 and 53 with projections 54 and 55. The cap holding structures 35 and 36 are formed on surfaces of the bottom half case 30 which faces the side surfaces 52 and 53 of the hinged cap 50 set at its closed position. The cap holding structures 35 and 36 are formed integrally with the bottom half case 30. The cap holding structure 35 has a rib 37 and a groove 39, and the cap holding structure 36 has a rib 38 and a groove 40. The grooves 39 and 40 have a width approximately equal to that of the projections 54 and 55, and are formed on paths along which the projections 54 and 55 move when the hinged cap 50 is turned on the hinge portion 51, respectively. The ribs 37 and 38 are formed on the paths of the projections 54 and 55, respectively. The projections 54 and 55 ride over the ribs 37 and 38 and drop into the grooves 39 and 40, respectively, to hold the hinged cap 50 at its closed position. Since the projections 54 and 55 are closely fitted in the grooves 39 and 40, the hinged cap 50 does not shake and can be lightly opened and closed.

The hinge cap 50 has a inner surface of a substantially semicircular shape in section defining a semicylindrical recess 56, a reinforcing rib 57 is formed at the middle of the recess 56. A ridge 58 extends along the upper edge of the inner surface of the hinge cap 50 parallel to the hinge portion 51. The ridge 58 is brought into contact with the lower surface of the flange 14, and a portion of a flat inner surface 59 of the hinged cap 50 over the ridge 58 comes into contact with the end surface 14*a* of the flange 14. When the hinged cap 50 is closed, any gap communicating with the interior of the flat tablet case is not formed between the hinged cap 50 and the top half case 10. The flange 14 is formed on the side of the inner surface of the top half case 10 as mentioned above, and the upper surface of the flange 14 is connected by a smooth, curved surface to the upper surface of the top half case 10 as shown in FIG. 3. The thin hinge portion 51 of the hinged cap 50 in a state where the hinged cap 50 is opened has a sectional shape as shown in FIG. 10. An edge portion 60 of the hinged cap 50 provided with the ridge 58 on its inner surface is curved slightly outward so as to extend away from the extremity of the flange 14. When opening the hinged cap 50, the flange 14 and the curved edge portion 60 facilitate pushing the hinged cap 50 with a finger tip so that the hinged cap 50 can be easily opened.

FIG. 11 shows hinged cap 65 in a modification of the hinged cap 50 shown in FIG. 10. As shown in FIG. 11, the hinged cap 65 has an inner surface and an outer surface each having a composite shape consisting of a curved section having a substantially quadrantal shape in section and a bent section having a shape substantially resembling the letter L in section. The hinged cap 65 is provided with a reinforcing rib 67 formed in a recess 66, and a ridge 68.

The bottom half case 30 may be provided with an exit partition wall 47 extending parallel to the shorter sides of the flat table carrying case as shown in FIG. 12 instead of the exit partition wall 33 shown in FIG. 6. The exit partition wall 47 is the same in effect as the exit partition wall 33.

FIG. 13 shows a bottom half case 70 corresponding to a bottom half case shown in FIG. 2. The arrangement of an exit partition wall and a partition wall in the bottom half case 70 is different from that of the corresponding partition walls of the bottom half case 30. An exit partition wall 71 is extended from the substantially middle portion of the inner surface of a shorter section of the side wall near a hinged cap 50 toward a position on the inner surface of a longer section of the side wall slightly dislocated toward the hinged cap from the middle of the inner surface of the longer section of the side wall; another exit partition wall 72 is extended from the inner surface of the longer section of the side wall so as to be aligned with an extension of the exit partition wall 71 with a predetermined space between the exit partition walls 71 and 72. Partition walls 73 and 74 are formed integrally with cap holding structures so as to extend parallel to the shorter sides of the case on the opposite sides of the hinged cap 50. The partition walls 73 and 74 are joined to the exit partition walls 71 and 72, respectively. The exit partition walls 71 and 72 enable only a small number of tablets 1 among those contained in the case to be taken out at a time.

The flat tablet case of the present invention is constructed by molding the bottom half case 30 integrally provided with the hinged cap 50, and the top half case 10 from a thermoplastic resin by injection molding, and joining together the top half case 10 and the bottom half case 30 by fitting the studs into the sockets. Therefore, the engagement of the hinged cap 50 of the bottom half case 30 is not affected at all by the dislocation the top half case 10 and the bottom half case 30 relative to each other due to the shrinkage of the moldings. If the engagement of the hinged cap is performed between the top half case 10 and the bottom half case 30, it may be difficult that the engagement of the hinged cap 50 is be accurately performed due to delicate dislocation of the top half case 10 and the bottom half case 30 relative to each other when the top half case 10 and the bottom half case 30 are joined together, because the top half case 10 and the bottom half 30 case are made separately by injection molding.

According to the present invention, the hinged cap 50 is formed integrally with the bottom half case 30, and the hinged cap 50 is held at the closed position by the engagement of the projections 54 and 55 formed on the opposite side surfaces 52 and 53 thereof with the cap holding structures 35 and 36 formed on the bottom half case 30. Therefore, the engagement of the hinged cap 50 is not dependent at all on the top half case 10, and it never occurs that the hinged cap 50 cannot be held at its closed position due to the dislocation of the top half case 10 and the bottom half case 30 relative to each other.

The projections 54 and 55 are able to ride over the ribs 37 and 38 easily when the hinged cap 50 is closed because the sliding surfaces of the projections 54 and 55 are sloped as shown in FIG. 3. Therefore, the hinged cap 50 can be closed and opened by moderate force.

The hinged cap will not be accidentally opened during use. The refreshing tablets 1 or the like contained in the flat tablet carrying case can be taken out from the flat tablet case by opening the cap and holding the flat table carrying case with the opening facing down. The exit partition wall makes it possible to deliver a small number of the tablets at a time.

Figure 14:
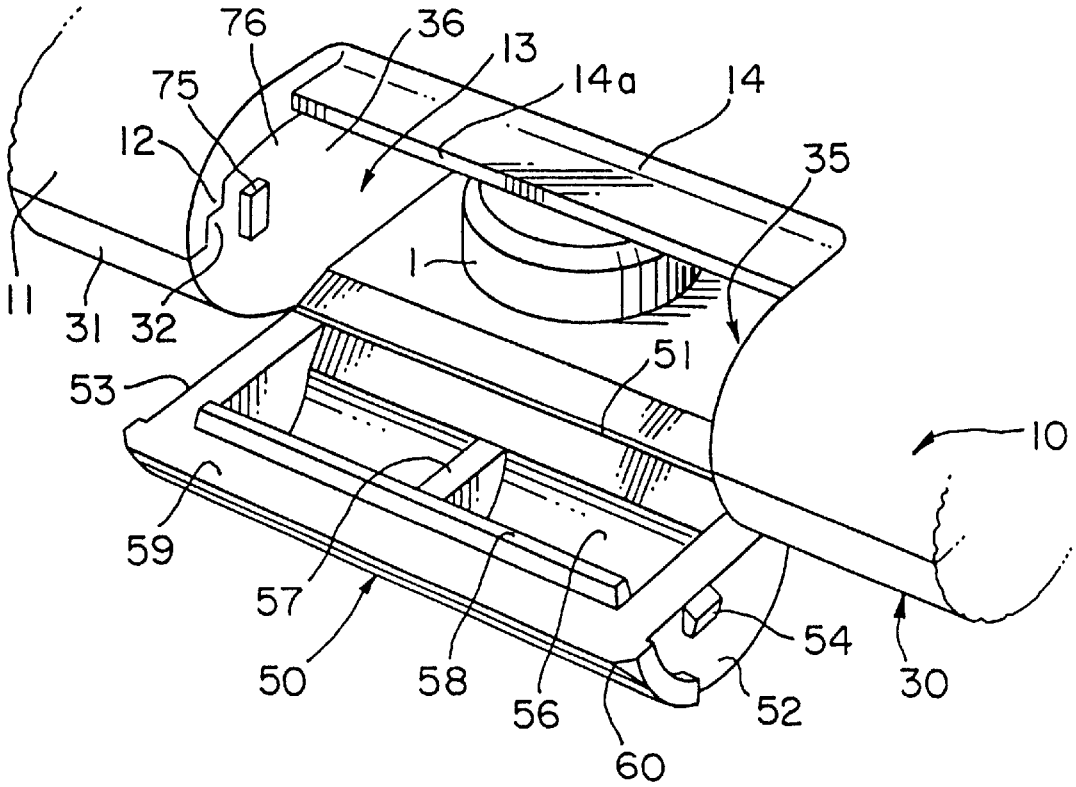
FIG. 14 is an enlarged perspective view of a portion of a flat tablet case around a hinged cap, provided with cap holding structures in a modification.

Cap holding structures 35 and 36 in a modification will be described with reference to FIG. 14. Referring to FIG. 14, the bottom half case 30 has flat surfaces 76 respectively facing the opposite side surfaces 52 and 53 of the hinged cap 50, and cap holding projections 75 are formed on the flat surfaces 76 so as to engage the projections 54 and 55 of the hinged cap 50. The cap holding projections 75 serve as the cap holding structures 35 and 36.

As is apparent from the foregoing description, the present invention provides an inexpensive, flat tablet case comprising a relatively small number of parts, easy to assemble, convenient to carry, satisfactory in usability and capable of delivering a small number of tablets at a time.

Particularly, since the hinged cap and the cap holding structures are formed integrally with the bottom half case, the dislocation of the top half case and the bottom half case relative to each other resulting from the shrinkage of the moldings does not affect the fit of the hinged cap at all.

Since the hinged cap is disposed in a section of the side wall of the flat tablet case, the hinged cap can be easily opened and closed, the contents can be easily shook out of the flat tablet case, and the hinged cap can be opened and closed by moderate force.

What is claimed is:

1. A flat tablet case with a hinged cap, comprising:

a bottom half case;

a top half case combined with the bottom half case; and a hinged cap having a hinge portion and formed integrally with one of the bottom half case and the top half case so as to swing on the hinge portion; wherein (1) a recess is formed in the other of the top half case and the bottom half case to receive the hinged cap therein, (2) the hinged cap is provided with projections on opposite side surfaces thereof, (3) the one half case integrally provided with the hinged cap has cap holding structures with which the projections of the hinged cap engage, and (4) both the bottom half case and the top half case are rectangular and the hinged cap and the recess are formed at portions of side edges of the corresponding half cases excluding corners of the half cases and in the vicinity of the corners, respectively.

2. The flat tablet case according to claim 1, wherein an edge portion of the hinged cap is curved outward.

3. The flat tablet case according to claim 1, wherein an exit partition wall for preventing the movement of a large number of contents toward the hinged cap is formed on an inner surface of the one half case near the hinged cap.

4. The flat tablet case according to claim 1, wherein studs are formed on an inner surface of the bottom half case or the top half case, and sockets capable of firmly receiving the studs are formed on an inner surface of the other of the top half case or the bottom half case.

5. The flat tablet case according to claim 4, wherein the one half case is provided with a partition wall formed on the inner surface thereof for preventing the entrance of contents in a space between the studs or the sockets and a side edge of the one half case.

* * * * *